US006834823B2

(12) United States Patent
Nauta et al.

(10) Patent No.: US 6,834,823 B2
(45) Date of Patent: Dec. 28, 2004

(54) SUPPLY DEVICE FOR SUPPLYING RUBBER MATERIAL TO A CUTTING DEVICE

(75) Inventors: Klaas Nauta, Epe (NL); Adrianus Theodorus Hendrikus De Keijzer, Lienden (NL)

(73) Assignee: Vmi Epe Holland B.V., Epe (NL)

( * ) Notice: Subject to any disclaimer, the term of this patent is extended or adjusted under 35 U.S.C. 154(b) by 68 days.

(21) Appl. No.: 10/294,448

(22) Filed: Nov. 14, 2002

(65) Prior Publication Data

US 2003/0089207 A1 May 15, 2003

Related U.S. Application Data

(63) Continuation of application No. PCT/NL01/00370, filed on May 17, 2001.

(30) Foreign Application Priority Data

May 17, 2000 (NL) ..... 1015220
Jun. 14, 2000 (NL) ..... 1015437

(51) Int. Cl.[7] ..... B65H 23/192; B65H 20/10; B29D 7/06; B29D 30/08

(52) U.S. Cl. ..... 242/418.1; 242/563.1; 242/564.3; 226/20; 226/42; 226/113; 226/118.1; 226/170; 156/405.1; 83/65; 83/240; 83/420; 83/271

(58) Field of Search ..... 242/564.3, 563.1, 242/417, 418.1; 226/20, 42, 44, 45, 94, 95, 113, 118.1, 170; 156/405.1, 406.4; 83/65, 240, 271, 420, 649, 650

(56) References Cited

U.S. PATENT DOCUMENTS

| | | | | | |
|---|---|---|---|---|---|
| 3,647,126 | A | * | 3/1972 | Dieterich et al. | 156/405.1 |
| 4,445,044 | A | * | 4/1984 | Buess | 242/418.1 |
| 4,824,001 | A | | 4/1989 | Mick, Jr. et al. | 156/64 |
| 4,832,243 | A | | 5/1989 | Usami | 226/108 |
| 4,838,137 | A | * | 6/1989 | Azuma | 83/650 |
| 5,135,601 | A | * | 8/1992 | Klose et al. | 242/564.3 |
| 5,193,424 | A | * | 3/1993 | Minichshofer et al. | 242/418.1 |
| 5,320,015 | A | * | 6/1994 | Minichshofer et al. | 242/564.3 |
| 5,904,788 | A | * | 5/1999 | Kitajima et al. | 156/406.4 |

FOREIGN PATENT DOCUMENTS

| | | |
|---|---|---|
| EP | 0201653 | 11/1986 |
| EP | 0919497 | 6/1999 |

* cited by examiner

*Primary Examiner*—John M. Jillions
(74) *Attorney, Agent, or Firm*—Ladas & Parry LLP

(57) ABSTRACT

Supply device for supplying rubber material (11) to a cutting device (3). In the direction away from the cutting device the supply device contains a supplying table (3) having a supplying mechanism (4), an unwinding trestle (7) containing a stock of rubber material, a space between the unwinding trestle (7) and the supplying table (3), which space is suitable for taking up a loop of rubber material forming a stock buffer. Between the unwinding trestle (7) and the supplying table (3), preferably at a distance above the supplying table, a first conveyor (5) having a drive is placed. Preferably at a distance above the unwinding trestle a second conveyor (8) having a drive is placed, in which the space for taking up the loop of rubber material is formed between the second (8) and the first (5) conveyor.

22 Claims, 1 Drawing Sheet

SUPPLY DEVICE FOR SUPPLYING RUBBER MATERIAL TO A CUTTING DEVICE

Figure 1:
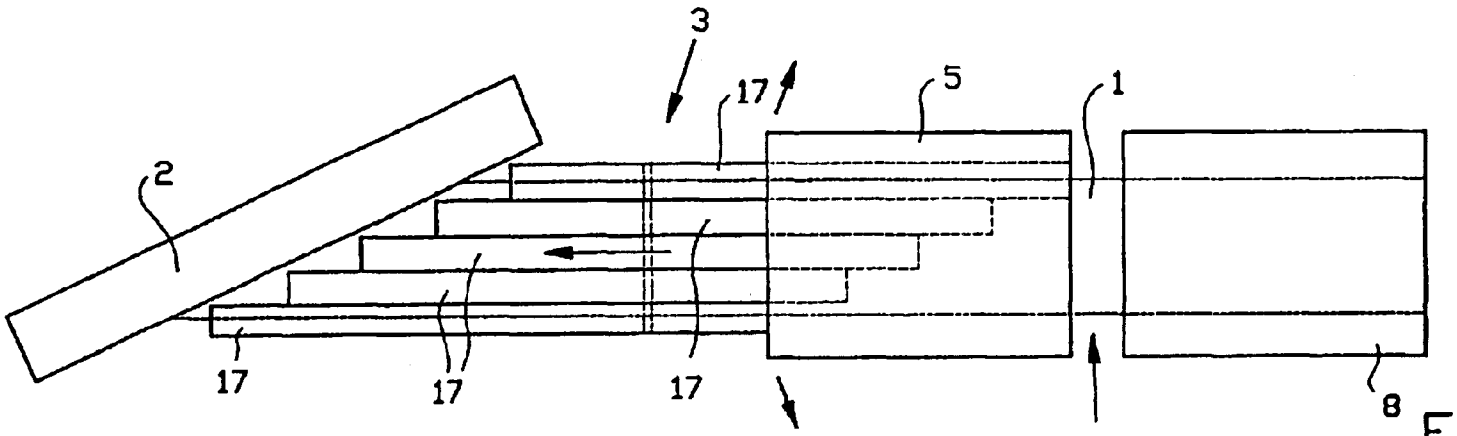

This application is a continuation of PCT/NL01/00370, filed May 17, 2001.

The present invention relates to a supply device for supplying rubber material to a cutting device, which supply device towards the cutting device is provided with:

an unwinding trestle holding a stock of rubber material, a supplying table having a supplying mechanism for supplying the rubber material to the cutting device and a space between the unwinding trestle and the supplying table, which space is suitable for taking up a loop of rubber material forming a stock buffer.

Such a supply device has been used for years. The supplying table is placed in front of the cutting device, and behind the cutting device a discharge system is placed, usually a conveyor belt, for discharging cut strips of rubber material. In front of the supplying table an unwinding trestle with a stock of ruber material is placed, in which between the unwinding trtestle and the supplying table a loop of rubber material is present. The operation of the assembly of such a supply device, cutting device and discharge system is intermittent. First rubber material is supplied, subsequently it is cut and then it is discharged. Depending on the exact design of the assembly these steps may partially overlap each other. During the operation of the whole, the loop works like a stock butter of rubber material to be supplied, ad the length of the loop is kept reasonably constant. In practice, however, it has appeared that the width of cut strips of rubber material is not the same everywhere. In the case the rubber material has been reinforced with cords of steel, textile or aramide, it has also appeared that at the beginning and at the end of the cut the cords are not always equally long. This leads to rubber strips of inferior or insufficient quality.

It is an object of the present invention to provide a supply device for the supplying of rubber material to a cutting device as a result of which the accuracy of the cut strips of rubber material is improved.

To that end a supply device of the kind described above is characterized in that between the space for taking up the loop of rubber material and the supplying table a first conveyor having a drive is placed.

The invention is based on the insight that the inaccuracy in the width of the cut strips of rubber material is caused by the weight of the rubber material present in the loop. Because of this weight the rubber material present on the supplying table can be retracted, as a result of which the position of the rubber material with respect to the cutting device is not accurately defined. Moreover, during the steps to be carried out of supplying, cutting and discharging, the length of loop is not always constant, as a result of which the weight of the loop differs. By, according to the invention, using a first conveyor between the loop and the supplying table, said first conveyor functions for buffering the weight of the loop of rubber material. As a result a more controlled supply to the supplying table is possible as well.

Moreover the use of the device according to the invention gives a solution to the following problem. Usually the rubber material and the cords present in it, are cut into strips by the cutting device at an angle of for instance 22° (other values are possible as well). After the cutting device there usually is a splicer in which the so-called trailing end of a strip is attached, spliced, to the so called leading end of another strip. The splice is accurate when at the location of the splice there is no difference in cord length, in other words when the strips are equally wide everywhere and have the exact same angle. Small differences in width and in the cutting angle, for instance a difference of ¼ mm in width or ¼° in the angle, which differences are hardly measurable and which in the known device are caused by tensile force on the rubber material as a result of the weight in the stock buffer loop, in a strip having for instance a width of 200 mm and a cutting angle of 22°, respectively, result in a measurable difference in cord length of 0.67 mm and 5.8 mm, respectively. Because of the supply device according to the present invention tensile force on the rubber material is prevented, and as a result no deviations in the strips arise. The final result is that the strips can be spliced to each other very accurately, in which no or in any case less differences in cord length arise that may cause the arising of deviations known in the art as "dogears".

Thus the supply device according to the present invention ensures that the rubber material is always placed in a defined manner with respect to the cutting device, and that the rubber strip to be manufactured in the end are equally wide everywhere, and that the cords present in the rubber material are equally long at the beginning and the end of the cut.

Preferably the first conveyor is placed at a distance above the supplying table. As a result rubber material arrives on the supplying table from above. This results in a certain bending in the rubber material where it arrives on the supplying table, which bending is defined by the rigidity of the rubber material. Said bending ensures a pushing or urging force, as a result of which the material further on at the supplying table remains in contact with the cutting device.

In a supply device described above preferably a second conveyor having a drive is placed between the unwinding trestle and the space for taking up the loop of rubber material. In this way deformation near the roll is also prevented. Additionally the length of the loop can be checked better, and the weight can be compensated better. It is preferred here that the second conveyor is placed at a distance above the unwinding trestle. First of all the weight of the loop is optimally compensated in this way. Additionally, by placing the second conveyor higher the space for the loop, which in actual practice will have a total length of 2.5 m, can be realised more easily.

Preferably the first conveyor is provided with means for centring the rubber material. It is preferred that the first conveyor is provided with means for positioning a side of the rubber material. It is preferred here that the first conveyor is provided with sensors for detecting the position of the rubber material and with an actuator for positioning the rubber material. In this way the accuracy of the supplying can be improved further.

Preferably the supplying mechanism of the supplying table and the drive of the first conveyor operate synchronously during a supplying movement of rubber material in the direction of the cutting device. It is preferred here that a sensor is provided for measuring the location where the rubber material arrives on the supplying table, which sensor issues a control signal to the supplying mechanism of the supplying table and/or the drive of the first conveyor.

Preferably a revolving roller is placed above the supplying table near the location where the rubber material arrives on the supplying table.

Preferably, when a first and second conveyor are provided, a bridging flap that can be swung aside is provided between the second and first conveyor.

Preferably, when a first and second conveyor are provided, means for centring rubber material are placed between the unwinding trestle and the second conveyor.

Means for positioning a side of the rubber material preferably are placed between the unwinding trestle and the second conveyor.

Preferably, in a supply device according to the invention means for centring rubber material are placed between the supplying table and the first conveyor.

Preferably, in a supply device according to the invention means for positioning a side of the rubber material are placed between the supplying table and the first conveyor.

In a supply device according to the invention the supplying table preferably has a number of parallel conveyor belts, driven by one central drive.

Preferably the parallel conveyor belts are slidable here with respect to each other in longitudinal direction.

It is preferred, in supply device according to the invention, that the supplying table is provided with means for generating a vacuum and/or a magnetic field.

In a supply device according to invention the first conveyor preferably is provided with first means for an almost slip-free retaining and transport of the strip on the first conveyor. The first conveyor can be provided with first means for retaining the strip on the transport surface of the first conveyor. Preferably the first means are provided with second means for generating a vacuum and/or a magnetic field on the transport surface.

Figure 2:
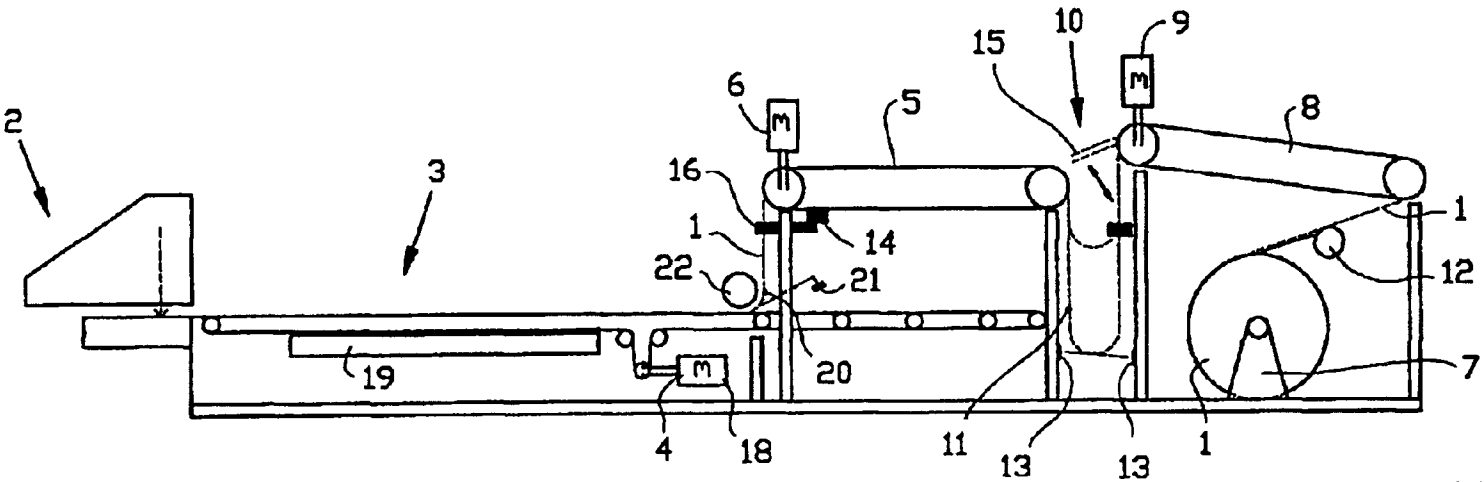

Below the invention will be described by way of example on the basis of the drawing. In which:

FIG. 1 shows a schematic top view of a supply device according to the present invention, and FIG. 2 shows a schematic side view of the supply device according to FIG. 1.

FIG. 1 shows a schematic top view and FIG. 2 a schematic side view of a supply device according to the present invention. The supply device supplies rubber material 1 to a cutting device 2. In the direction away from the cutting device 2, the supply device contains a supplying table 3 having supplying mechanism 4, a first conveyor 5 having a drive 6 at a distance above the supplying table 3, an unwinding trestle 7 holding a stock of rubber material 1, a second conveyor 8 having a drive 9 at a distance above the unwinding trestle 7, a space 10 between the second 8 and the first conveyor 5, which space 10 is suitable for taking up a loop 11 of rubber material forming a stock buffer.

Between the unwinding trestle 7 and the second conveyor 8 means 12 are preferably arranged for centering rubber material 1 and/or means 12 are placed for positioning a side of the rubber material 1. As a result the rubber material 1 is correctly positioned from the beginning, which has advantages for the accuracy of the strips of rubber material to be cut in the end. The positioned rubber material is transported by the second conveyor 8 by means of drive 9 and here forms a stock loop 11. The length of the loop 11 can here be determined in a manner known per se and be kept constant by means of sensors 13.

In order to prevent that as a result of forming and maintaining the loop 11, the position of the rubber material 1 is changed, the first conveyor 5 preferably is provided with means 14 for centring rubber material 1 and/or with means 14 for positioning a side of the rubber material 1.

The means 12, 14 preferably have sensors for detecting the position of the rubber material and with an actuator for positioning the rubber material, so that positioning can take place easily yet accurately.

The first conveyor 5 placed high, isolates or neutralises, respectively, the weight of the loop 11 of rubber material of the supplying table 3, as a result of which the loop 11 no longer exerts tensile force on the rubber material present on the supplying table 3.

The bridging of the rubber material of the second conveyor belt 8 to the first conveyor belt 5, is carried out, for instance manually, at the beginning of a new stock roll of rubber material 1 on the unwinding trestle 7, by means of bridging flap 15 that can be swung aside. Said bridging flap 15 is particularly advantageous in case of heavy rubber material, for instance rubber material provided with thick steel cords that lie close together.

In order to ensure that the rubber material 1 is correctly positioned on the supplying table 3, means 16 are provided between the supplying table 3 and the first conveyor 5 for centring rubber material 1 and/or means 16 are placed for positioning a side of the rubber material.

Although several embodiments of a supplying table 3 are possible, it is preferred, because of the possibility to be able to cut the rubber material at different angles, that the supplying table 3 has a number of parallel conveyor belts 17, driven by one central drive 18. In order to realise adjustment for a wanted cutting angle in a simple manner, the parallel conveyor belts 17 are slidable with respect to each other in longitudinal direction.

To retain the position of the rubber material 1 during transport on the supplying table, the supplying table 3 preferably is provided with means 19 for generating a vacuum and/or a magnetic field.

An optimal operation of the supply device according to invention is achieved when the supplying mechanism 18 of the supplying table 3 and the drive 6 of the first conveyor 5 operate synchronously during a supply movement of rubber material 1 in the direction towards the cutting device 2. Possible small differences in speed can be corrected by providing in a sensor 21 for measuring the location where the rubber material 1 arrives on the supplying table 3. The sensor 21 gives a control signal to the supplying mechanism 18 of the supplying table 3 and/or the drive 6 of the first conveyor 5.

Because the rubber material 1 arrives on the supplying table 3 from the first conveyor 5 that is placed high, a certain bending 20 arises in the rubber material 1 where it arrives on the supplying table as a result of the rigidity of the rubber material. Said bending 20 ensures a pushing or urging force, as a result of which the rubber material 1 further on at the supplying table 3 remains in contact with the cutting device 2.

Particularly in case of very flexible rubber material 1, there is the advantage to provide in a revolving roller 22, placed above the supplying table 3 near the place where the rubber material 1 arrives on the supplying table 3. The rubber material 1 then abuts this revolving roller 22, as a result of which a very correct placing of rubber material on the supplying table 3 is possible.

What is claimed is:

1. A supply device for supplying rubber material to a cutting device, which supply device towards the cutting device comprises:

an unwinding trestle holding a stock of rubber material;

a supplying table having a supplying mechanism for supplying the rubber material to the cutting device;

a space between the unwinding trestle and the supplying table for taking up a loop of the rubber material as a stock buffer; and a first conveyor between the space and the supplying table, the first conveyor having a drive, wherein the first conveyor is at a distance above the supplying table for supplying the rubber material to the supplying table from above and bending the rubber material for ensuring a pushing or urging force on the rubber material for maintaining contact with the cutting device.

2. The supply device according to claim 1, characterized in that between the unwinding trestle and the space for taking up the loop of rubber material a second conveyor having a drive is placed.

3. The supply device according to claim 2, characterized in that the second conveyor is placed at a distance above the unwinding trestle.

4. The supply device according to claim 1, characterized in that the first conveyor is provided with means for centering the rubber material.

5. The supply device according to claim 1, characterized in that the first conveyor is provided with means for positioning a side of the rubber material.

6. The supply device according to claim 5, characterized in that the first conveyor is provided with sensors for detecting the position of the rubber material and with an actuator for positioning the rubber material.

7. The supply device according to claim 1, characterized in that the supplying mechanism of the supplying table and the drive of the first conveyor operate synchronously during a supplying movement of the rubber material in the direction of the cutting device.

8. The supply device according to claim 7, characterized in that a sensor is provided for measuring the location where the rubber material arrives on the supplying table, which sensor issues a control signal to the supplying mechanism of the supplying table and/or the drive of the first conveyor.

9. The supply device according to claim 1, characterized in that a revolving roller is placed above the supplying table near the location where the rubber material arrives on the supplying table.

10. The supply device according to claim 2, characterized in that a bridging flap that can be swung aside is provided between the second conveyor and the first conveyor.

11. The supply device according to claim 2, characterized in that means for centering rubber material are placed between the unwinding trestle and the second conveyor means.

12. The supply device according to claim 11, characterized in that means for positioning a side of the rubber material are placed between the unwinding trestle and the second conveyor.

13. The supply device according to claim 12, characterized in that means for centering rubber material are placed between the supplying table and the first conveyor.

14. The supply device according to claim 13, characterized in that means for positioning a side of the rubber material are placed between the supplying table and the first conveyor.

15. The supply device according to claim 14, characterized in that the supplying table has number of parallel conveyor belts, driven by one central drive.

16. The supply device to claim 15, characterized in that the parallel conveyor belts are slidable with respect to each other in longitudinal direction.

17. The supply device according to claim 16, characterized in that the supplying table is provided with means for generating a vacuum and/or a magnetic field.

18. The supply device according to claim 17, characterized in that the first conveyor is provided with first means for an almost slip-free retaining and transport of the strip on the first conveyor.

19. The supply device according to claim 18, characterized in that the first conveyor is provided with a transport surface, the first means for retaining the strip on the transport surface of the first conveyor.

20. The supply device according to claim 19, in which the first means are provided with second means for generating a vacuum and/or a magnetic field.

21. The supply device according to claim 20, characterized in that the rubber material is a strip reinforced with cords.

22. The supply device of claim 21, wherein the cords are made of material selected from the group consisting of steel, textile and aramide.

* * * * *